United States Patent [19]

Gann

[11] Patent Number: 4,613,067

[45] Date of Patent: Sep. 23, 1986

[54] SHOOTING AND CARRYING SLING FOR GUNS

[75] Inventor: Larry N. Gann, Independence, Mo.

[73] Assignee: Button Sling, Inc., Independence, Mo.

[21] Appl. No.: 823,137

[22] Filed: Jan. 27, 1986

Related U.S. Application Data

[63] Continuation of Ser. No. 687,592, Dec. 31, 1984, abandoned.

[51] Int. Cl.[4] ..... F41C 23/02

[52] U.S. Cl. ..... 224/150; 224/257; 224/913

[58] Field of Search ..... 224/150, 913, 257; 24/2.5

[56] References Cited

U.S. PATENT DOCUMENTS

| | | | |
|---|---|---|---|
| 919,301 | 4/1909 | Anderson . | |
| 1,088,314 | 2/1914 | Wilcke . | |
| 1,655,527 | 1/1928 | Abrahams . | |
| 2,536,252 | 1/1951 | Bates . | |
| 2,647,667 | 8/1953 | Brown et al. . | |
| 2,873,902 | 2/1959 | Decker | 224/257 |
| 3,557,485 | 1/1971 | Williams . | |
| 3,655,106 | 4/1972 | Wojcinski | 224/913 X |
| 3,869,074 | 3/1975 | Roach . | |
| 3,893,604 | 7/1975 | Skinner | 224/257 |
| 4,291,822 | 9/1981 | Simonds | 224/257 |
| 4,331,271 | 5/1982 | Anderson | 224/913 X |

FOREIGN PATENT DOCUMENTS

| | | |
|---|---|---|
| 208445 | 3/1909 | Fed. Rep. of Germany . |

*Primary Examiner*—Stephen Marcus
*Assistant Examiner*—Robert Petrik
*Attorney, Agent, or Firm*—Schmidt, Johnson, Hovey & Williams

[57] ABSTRACT

A gun sling in the nature of an elongated, flexible strap, worn over one shoulder of the user, has a front end portion which depends from the shoulder and is provided with a buttonhole for coupling with a stud mounted on the gun. A rear end portion of the strap extends downwardly at an angle from the shoulder along the back of the torso to a waistbelt worn by the user. A ring connected to the rear portion receives an S-clip which hooks over the waistbelt. Consequently, the shotgun in the carrying position is supported substantially by the strap yet may be easily and rapidly shifted to a firing position wherein the strap hangs in loose, non-binding relationship to the gun without detachment therefrom.

6 Claims, 7 Drawing Figures

SHOOTING AND CARRYING SLING FOR GUNS

This application is a continuation, of application Ser. No. 687,592, filed Dec. 31, 1984, and now abandoned.

BACKGROUND OF THE INVENTION

1. Field of the Invention

This invention relates to a gun sling adapted especially and specifically for the hunter to ease the burden of carrying the gun while, at the same time, permitting rapid and accurate movement of the gun to an aiming and firing position.

2. Description of the Prior Art

A variety of slings, belts and carriers have been proposed for suspending or supporting a rifle or shotgun from the body of the user. Generally, the object has been merely to relieve some of the weight of the weapon from the user's hands or arms.

Typically, gun slings comprise a flexible strap adapted to be connected at one end to the butt of the gun and at the opposite end to a connector mounted on or adjacent the mid-section of the gun barrel. Unfortunately, such slings have proved to be unsatisfactory for hunters because the length of strap necessary to preclude binding during aiming is normally too long for a comfortable, convenient orientation of the firearm when supported by the strap during walking or rest. Additionally, since the strap is worn over the outer garments, the strap must be lengthened or shortened whenever the thickness of the outer clothing is changed.

Another type of carrier which has heretofore been suggested comprises a belt having a pocket or other support for detachable connection to the butt end of the firearm. Often, a second strap is placed over the chest of the user carries a clip or hook which is engageable with the barrel or forearm of a firearm. In use, the gun is detached from the clip or hook and then shifted upwardly for withdrawal of the butt end from the pocket. Such a carrier requires a thoughtful sequence of carefully executed, time consuming muscular movements merely to raise the weapon to a firing position, as well as an attentive effort when reversing the procedure for reinsertion of the gun into the carrier. The use of a carrier of this type prevents the hunter from instantaneously raising and aiming the firearm to follow birds and other game. Also, the necessary multiplicity of belt and straps must be worn over the outer clothing of the user, thereby facilitating entanglement with the underbrush and prohibiting rapid and easy uncloaking of the outer garments.

As can be appreciated, there exists a long-felt need in the art for a gun carrier which is comprised of a minimum number of straps or belts yet is operable to support the firearm and thus relieve muscle fatigue. Additionally, such a device should not hinder raising the weapon to a firing position nor burden the user with a detailed procedure for resupporting the weapon whenever the latter is not in use.

SUMMARY OF THE INVENTION

The present invention overcomes, the above disadvantages of prior art firearm carriers. My gun sling effectively supports the gun during non-firing interludes, yet the gun may be instantly brought into a firing position with a minimum of effort or attention on the part of the wearer.

The gun sling of the instant invention includes an elongated flexible strap which has a front end portion detachably coupled to the main stock section of the firearm. The middle portion of the strap is positionable over one of the shoulders of the wearer, and the rear end portion of the strap depends from the shoulder and diagonally across the back of the user for attachment with a waistbelt. If the user is clothed in an outer jacket or vest, the rear portion of the strap may be worn interiorly of the jacket or vest while the front end portion of the strap may be extended through the lowermost segment of the frontal neck opening for engagement with the firearm.

As a result, the weight of the gun is substantially carried by the strap yet is counterbalanced by either arm or hand of the wearer. The flexibility and unrestrained length of the strap is such that the weapon is rapidly shiftable between a number of comfortable, non-firing positions whereby muscle strain, stiffness and soreness may be avoided. Also, the gun may be advantageously moved between the different positions when the user is crossing fences, climbing, sitting or burdened with game and supplies.

In contrast, the gun may also be rapidly raised to a firing position without any interference from the sling or associated connectors. When the gun is aimed, the strap, being connected only to the forearm of the gun stock, hangs freely and thereby completely avoids unnecessary restraints of movement. Consequently, the instant invention advances the art to a degree heretofore unrecognized.

DETAILED DESCRIPTION OF THE DRAWINGS

Figure 1:
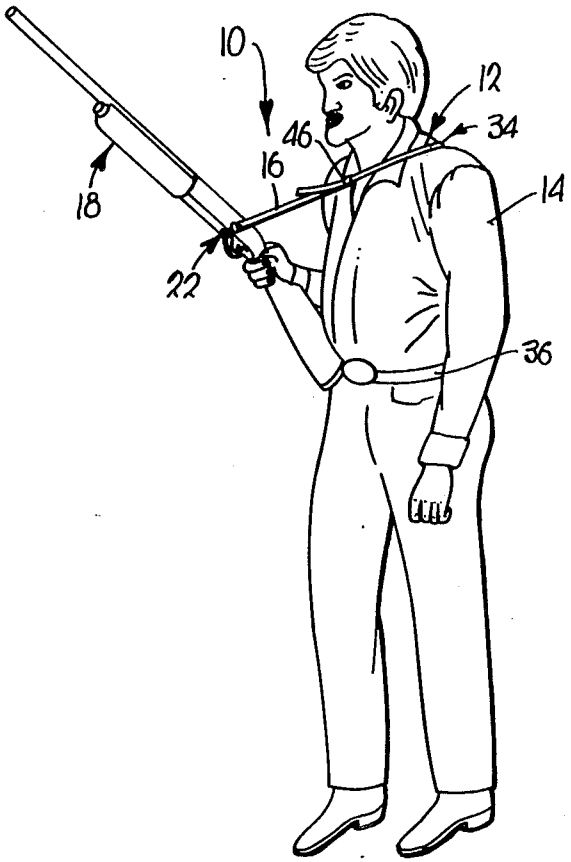
FIG. 1 is a view of the gun sling shown as attached to the firearm and worn by the user.

A shooting and carrying sling for firearms such as rifles and shotguns, designated broadly by the numeral 10, includes an elongated, flexible strap 12, preferably constructed of leather and adapted to be worn over one of the shoulders of a wearer 14.

The strap 12 has a front end portion 16 which depends from the shoulder of the wearer 14 adjacent the front of the torso. A means for coupling the portion 16 to a shotgun 18 includes a buttonhole 20 in the portion 16 disposed adjacent its normally lowermost terminus. The buttonhole 20 releasably receives a button stud 22 mounted on the shotgun 18.

The stud 22 includes a cylindrical shaft 24 which extends into an opening 25 and through the gun 18 adjacent its trigger, replacing a pin (not shown) normally used to retain the trigger assembly in the gun 18. A pair of peripheral grooves 26 matingly engage locking clips (not shown) within the trigger assembly and a screw 28 is threaded into one end 27 of the shaft 24 to clamp the latter in place. Additionally, the cylindrical shaft 24 of the button stud 22 terminates at the opposite end thereof in an enlarged, disk-shaped head 30 which has an outwardly diverging undercut portion 32 adjacent the shaft 24.

The strap 12 also includes a rear end portion 34 which extends downwardly from the shoulder of the wearer 14 adjacent the back of the torso to the waist area. A means for connecting the portion 34 to a waistbelt 36 adjacent the back of the wearer 14 comprises an S-clip 38 having a loop 39 adapted to be hooked to the waistbelt 36. The somewhat flattened S-clip 38 has a second loop 41 hooked to a ring 40 which is, in turn, threaded onto a looped segment 43 of the portion 34.

Means for selectively adjusting the length of the strap 12 includes a series of spaced openings 42 in the portion 34 and a pin 44. The pin 44 is selectively received by any one of the openings 42 whereby the segment 43 may be incrementally lengthened or shortened.

A second means for selectively adjusting the length of the strap 12 comprises a pair of D-rings 46 fastened to a looped segment 47 of the portion 34. The rings 46 receive the portion 16 and preferably are slightly serrated for a nonslipping, gripping engagement with the portion 16.

Normally, the portion 34 is positioned diagonally across the back of the wearer 14 wherein the strap 12 lies across one shoulder of the body and the portion 34 extends downwardly toward the waist area below the opposite shoulder. The weight of the gun 18 when carried by the strap 12 is substantially supported by the shoulder but is also counterbalanced by one of the hands or arm of the user.

FIGS. 1–3 and 5 illustrate the use of the sling 10 in three of the various available gun carrying positions. In FIG. 1, the butt of the gun 18 is rested against the waist area of the wearer 14 while the strap 12 extends outwardly and slightly downwardly from the shoulder to carry a portion of the weight of the firearm. As shown, this positioning of the gun 18 is useful when standing still or slowly advancing in the field since the longitudinal axis of the barrel is inclined upwardly in disposition for rapid shifting to a firing position. The right hand of the user grasps the shotgun 18 merely to steady the latter.

Figure 2:
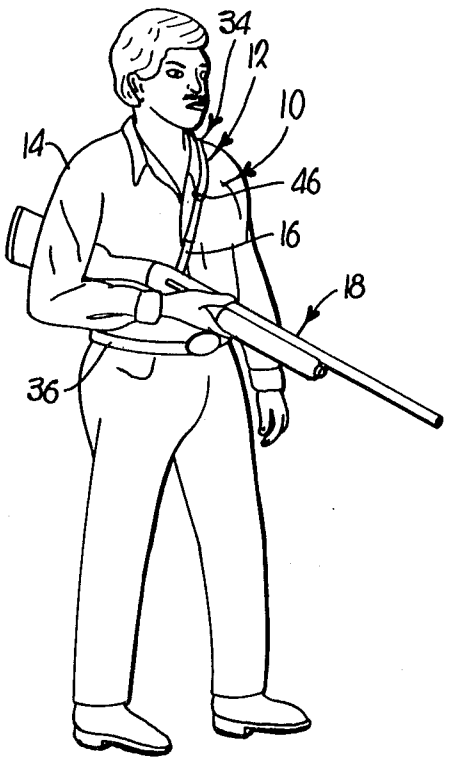
FIG. 2 is a view similar to FIG. 1 illustrating another position of the gun and sling in use.
Figure 5:
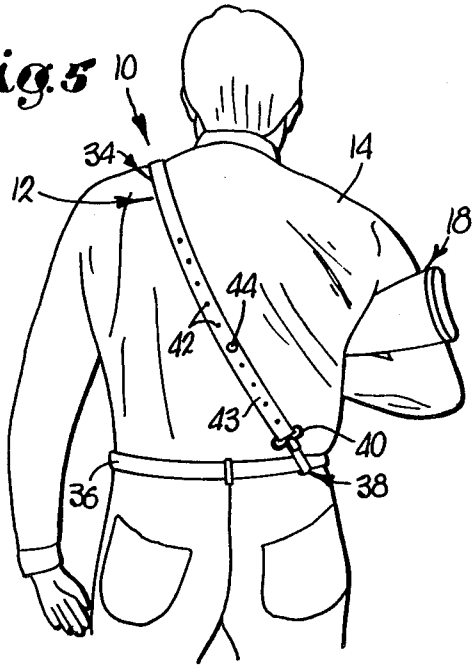
FIG. 5 is a rear view of the wearer illustrating the position of the strap in use.

In FIGS. 2 and 5, the weight of the gun 18 is supported substantially by the strap 12 while the butt of the gun 18 rests within or adjacent the armpit of the wearer 14. Again, the right hand is used to steady, but not necessarily support, the gun 18. In this position, the longitudinal axis of the barrel extends outwardly at a slight downward angle such that accidental discharge would not likely cause serious injury to the wearer 14 or fellow hunters. Additionally, this position of the gun 18 is useful when walking because movement of the legs or thighs will only slightly jostle or otherwise displace the gun 18 engaging only the upper torso of the wearer 14.

Figure 3:
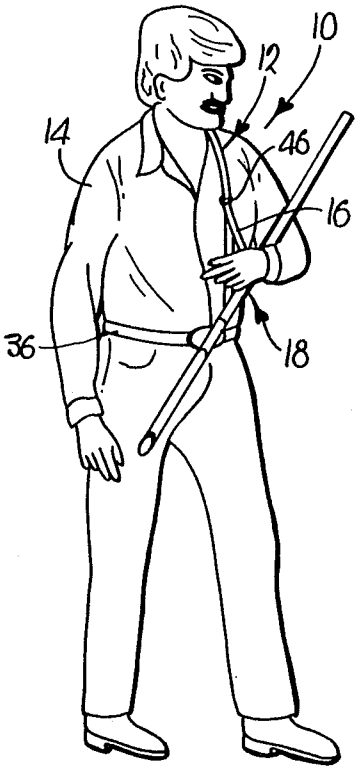
FIG. 3 is a view similar to FIG. 1 showing yet another orientation of the strap and shotgun across the front of the wearer.
Figure 7:
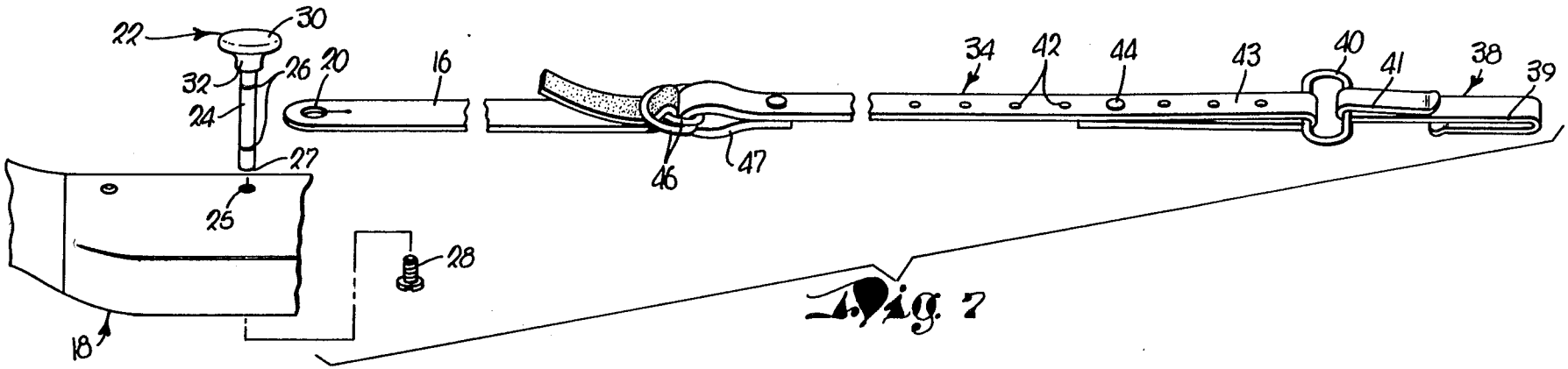
FIG. 7 is an enlarged, perspective, fragmentary view showing the sling, a portion of the gun stock, and the button stud assembly, the latter being shown as disassembled for clarity.

Referring to FIG. 3, the gun 18 is illustrated as resting diagonally across the front torso and somewhat cradled in the inner elbow joint of the left arm. Here, the weight of the gun 18 is again substantially carried by the strap 12 and the left arm is used to steady the gun 18 during body movement.

Noteworthy is the fact that the gun 18 may be easily and rapidly shifted between the various positions shown in FIGS. 1–3 and 5 such that the unused arm may be dropped to the side of the user to completely relax the muscles. Additionally, the opposite arm, when used to steady the gun 18, normally need support only a small percentage of the firearm's weight. The supporting nature of the strap 12 along with the multiplicity of available positions precludes muscle stiffness or fatigue which otherwise would soon tire the user and noticeably affect marksmanship.

Figure 4:
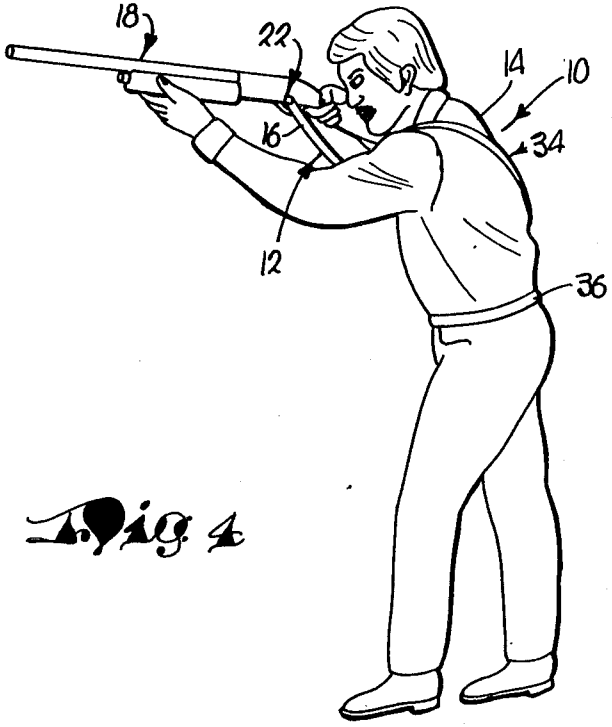
FIG. 4 is a view similar to FIG. 1 illustrating a gun in a position ready for firing.

In FIG. 4, the gun 18 is shown lifted to a normal firing position wherein the strap 12 hangs rather loosely to avoid binding or other resistance to careful aim. The gun 18 may be easily raised to the firing position shown in FIG. 4 from any of the carrying positions shown in FIGS. 1–3 and 5 without the necessity of disengaging barrel clips or butt pockets as is common in prior art constructions. As a result, the gun 18 is instantly accessible for firing such that bird calls may be utilized at the latest possible time prior to aiming.

Figure 6:
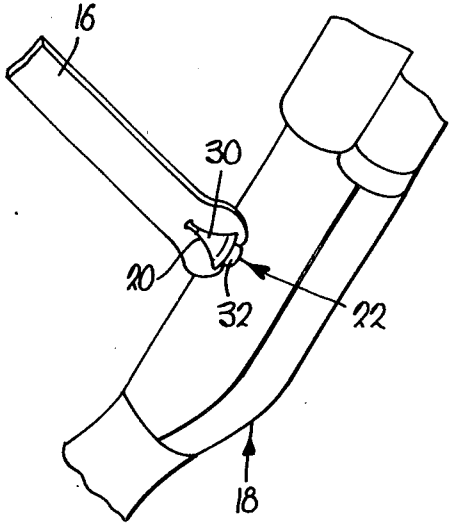
FIG. 6 is an enlarged, perspective, fragmentary view detailing the means of connecting the front portion of the strap to the gun stock.

As shown ion FIG. 6, the portion 32 of the head 30 is useful to "break" the buttonhole 20 away from the stud 22. Consequently, the gun 18 may be merely twisted to disengage the latter from the strap 12 and the wearer 14 need not grasp the portion 16 for disengagement from the gun 18. Such feature can be advantageously utilized in a wide variety of circumstances, particularly when climbing, crawling through underbrush, or in emergency situations.

Additionally, the fact that the sling 12 may be lengthened either in the portion 16 or the portion 34 allows a great degree of freedom of movement as well as comfortable adjustment. In particular, the strap 12 may be adjusted approximately to the correct length by means of the pin 44 within the openings 42, while the rings 46 may be easily reached for precise adjustment of the portion 16. The wearer 14 may conveniently adjust the rings 46 when necessary to properly balance the gun 18 in carrying positions.

I claim:

1. A sling for carrying an elongated firearm by a waistbelt-clad wearer, said firearm having a trigger assembly normally retained by pin means situated within an opening in the firearm adjacent the trigger assembly, said sling comprising:

an elongated flexible strap provided with a front end portion and a rear end portion;

means for releasably coupling said rear end portion to the waistbelt of the wearer adjacent the wearer's back;

said strap being of a length for extending upwardly from said waistbelt coupling means along the back and over one shoulder of the wearer with said front end portion terminating above the wearer's waistbelt; and means for attaching said firearm to said front end portion of said strap for supporting the firearm and permitting rapid movement of the firearm to a shoulder firing position without the necessity of delatching the firearm from the strap, said attachment means comprising a stud for insertion into the firearm opening adjacent said trigger assembly; and means for operatively and releasably connecting said stud and strap when the stud is operatively inserted into said firearm opening.

2. A sling as set forth in claim 1, including means for adjusting the length of said strap.

3. A sling as set forth in claim 1, said coupling means comprising an S-clip operatively connected to said rear end portion of said strap and adapted for hooking to said belt.

4. A sling as set forth in claim 1, said strap being of a length for extending upwardly and diagonally across the back of said wearer.

5. A sling as set forth in claim 1, said stud comprising an elongated shaft with an enlarged strap-receiving head.

6. A sling as set forth in claim 5, said means operatively and releasably connecting said stud and strap comprising a buttonhole provided in said strap adjacent said front end portion of the strap for receiving said stud head.

* * * * *